US006178610B1

(12) United States Patent
Piller et al.

(10) Patent No.: US 6,178,610 B1
(45) Date of Patent: Jan. 30, 2001

(54) METHOD OF AND APPARATUS FOR REMOVING BURRS FROM METAL WORK-PIECE

(75) Inventors: Thomas Piller, Ditzingen; Rolf Wankmüller, Leonberg, both of (DE)

(73) Assignee: Piller Entgrattenchnik GmbH (DE)

( * ) Notice: Under 35 U.S.C. 154(b), the term of this patent shall be extended for 0 days.

(21) Appl. No.: 09/297,944

(22) PCT Filed: Jul. 24, 1998

(86) PCT No.: PCT/EP98/04653

§ 371 Date: May 10, 1999

§ 102(e) Date: May 10, 1999

(87) PCT Pub. No.: WO99/12665

PCT Pub. Date: Mar. 18, 1999

(30) Foreign Application Priority Data

Sep. 11, 1997 (DE) ..... 197 39 868

(51) Int. Cl.[7] ..... B23P 9/00; B23C 9/00; B08B 7/04; B24C 1/00

(52) U.S. Cl. ..... 29/33 A; 15/320; 29/DIG. 7; 29/DIG. 39; 134/10; 134/151; 134/172; 451/38

(58) Field of Search ..... 29/33 A, DIG. 7, 29/DIG. 39, DIG. 88; 134/10, 66, 172, 22.11, 22.12, 25.4, 103.1, 151; 409/131, 135, 136, 137; 15/320; 82/1.11; 451/38.87; 408/1 R, 56, 61, 67; 239/DIG. 8, 127

(56) References Cited

U.S. PATENT DOCUMENTS 4,555,876 * 12/1985 Ohtake ..... 451/81
4,893,642 * 1/1990 Parlson, Jr. et al. ..... 134/66
5,314,545 5/1994 Folts et al. .
5,645,382 7/1997 Homanick et al. .

FOREIGN PATENT DOCUMENTS

4326518A1 2/1995 (DE) .
1933579A1 3/1996 (DE) .
0849044A1 6/1988 (EP) .
95108516 9/1991 (EP) .
2039461A 1/1979 (GB) .
55096249 7/1980 (JP) .
58-135646 * 8/1983 (JP) ..... 29/33 A
60-152034 * 10/1985 (JP) ..... 29/33 A
60255346 12/1985 (JP) .
3-274757 * 5/1991 (JP) ..... 29/33 A

* cited by examiner

*Primary Examiner*—William Briggs
(74) *Attorney, Agent, or Firm*—Jansson, Shupe, Bridge, & Munger, Ltd,

(57) ABSTRACT

A method of and device for removing burrs from metal work-pieces processed by a metal processing machine is provided. The method and device both include the burrs being removed by a high pressure stream of liquid that exits a high pressure nozzle and is directed at the work-piece that is to have the burrs removed. An integration of the burr removal step into the manufacturing sequence of the parts on commercial metal processing machines is made possible by the fact that the high pressure stream of liquid that is used has a proportion of oil of greater than 50% and a high pressure of greater than 400 bar.

13 Claims, 2 Drawing Sheets

METHOD OF AND APPARATUS FOR REMOVING BURRS FROM METAL WORK-PIECE

RELATED APPLICATION AND CLAIM OF PRIORITY

This application is a nationalication of PCT Application No. PCT/EP98/04653 having an international filing date of Jul. 24, 1998, which designates at least one country in addition to the United States and which claims priority from German Application No. 197 39 868.5 filed Sep. 11, 1997. For priority purposes, this application continues the above-noted PCT application and claims the benefit of 35 USC 371 and/or 35 USC 120.

FIELD OF THE INVENTION

The invention generally relates to metal processing machines and more particuarly, to a device for and a method of removing burrs from metal work-pieces processed on a shavings metal processing machine, wherein the method and device use a high pressure stream of liquid exiting a high pressure nozzle directed at the work-piece to be processed to remove the burrs.

BACKGROUND OF THE INVENTION

A method of and a device for removing burrs from metal work-pieces processed on a metal processing machine are known from DE 195 33 579 A1 (hereinafter DE '579). In the DE '579 reference, the high pressure stream of liquid is an oil emulsion having a high pressure of up to 500 bar. Oil emulsions of the type taught in DE '579 contain a maximum of 10 to 15% oil in water and additives, such as emulsifiers, which allow for the finest distribution of the oil in the water (since oil and water do not tend to mix). The action of removing burrs is achieved specifically by the water, which is heavier than the oil. Most of the current commercially available devices are operated at a maximum of 350 bar. A high pressure stream of liquid comprised mainly of water used at a high pressure maximum of 350 bar is usually sufficient to achieve adequate burr removing and cleaning action. Burr removing and cleaning action, as the DE '579 reference shows, can readily be integrated into the manufacturing process of the work-piece, if carried out in the machine chamber and if the boring and cutting emulsion is used that is already employed for the cooling of the work-piece to be processed.

But there are now ever increasing numbers of metal processing machines being operated using cutting oil or boring oil as the cooling and lubricating medium, where the oil is not finely distributed in the emulsions, but rather is provided as a solution with additives. As a consequence of this, the emulsions only contains a negligible proportion of water.

An object of the present invention is to provide a method of and a device for removing burrs from metal work-pieces processed by metal processing machines, wherein oil can also be employed in the high pressure stream of liquid without any danger and with sufficiently great burr removing and cleaning action.

SUMMARY OF THE INVENTION

The method of and device for removing burrs from metal parts processed by a metal processing machine according to the present invention is characterized by the fact that a high pressure stream of liquid is used which has a proportion of oil greater than 50% and a high pressure greater than 400 bar. The method and device are further characterized in that the high pressure nozzle, along with the work-piece to be processed, are housed in an encapsulated work-piece chamber during processing. Thus, with high pressure greater than 400 bar, sufficient burr removing and cleaning action is achieved using the specifically lighter oil. The housing of the high pressure nozzle and the work-piece to be processed in the encapsulated work-piece chamber results in the fact that an oil mist, generated by the burr removal, does not present the danger of fire or explosion, because the volume of the work-piece chamber is kept small and the work-piece chamber can easily be uncoupled from the machine chamber via a door that can be opened and closed. Furthermore, processes that are being conducted in the work-piece chamber and in the machine chamber do not mutually impair one another. The oil mist cannot exit the machine chamber so as to lead to any build up of dirt.

The safety of the method and device of the present invention is increased even more according to a further design, wherein the work-piece chamber is supplied with carbon dioxide or nitrogen by a supply of gas during the processing of the work-piece.

The device to remove burrs from a metal work-piece processed on a metal shavings removal processing machine, wherein the metal processing machine has at least one processing station in a machine chamber thereof and a high pressure nozzle directed at the work-piece to be processed and supplied with the high pressure stream of liquid, is characterized by the fact that the oil for the high pressure stream of liquid is taken from an oil tank of the metal processing machine, brought up to a high pressure greater than 400 bar via a high pressure generating device, and supplied to the high pressure nozzle housed in a work-piece chamber together with the work-piece, whereby the work-piece chamber is arranged in the machine chamber.

Thus, no additional handling expense is required to remove burrs and to clean the work-piece. The finishing time for the work-pieces is thereby considerably shortened. The loosened burrs are transported away in the metal processing machine in the same way as the metal shavings in the metal removal processing. For this purpose, the work-piece chamber only need be provided with an exiting drain which is connected to the oil drain device of the metal processing machine.

The oil from the oil tank of the metal processing machine is supplied to the high pressure generation device, either directly, or through an intermediate oil for removing burrs from metal work-pieces processed on a metal processing machine.

For larger work-pieces, a plurality of additional high pressure nozzles can be arranged in the work-piece chamber and supplied from the high pressure generating device. The high pressure generating device has an operating direction and a distance to the work-piece to be processed, wherein the operating direction and the distance are adjustable. Multiple high-pressure nozzles can be directed at a single work-piece, or each work-piece of a plurality of work-pieces can have one or more high pressure nozzles allocated thereto.

The design can furthermore be executed such that the high pressure generation device is constructed as a component that is separate from the metal processing machine.

BRIEF DESCRIPTION OF THE DRAWING FIGURES

The present invention is explained more closely on the basis of exemplified embodiments illustrated in block schematics, as follows.

DETAILED DESCRIPTION OF THE INVENTION

Figure 1:
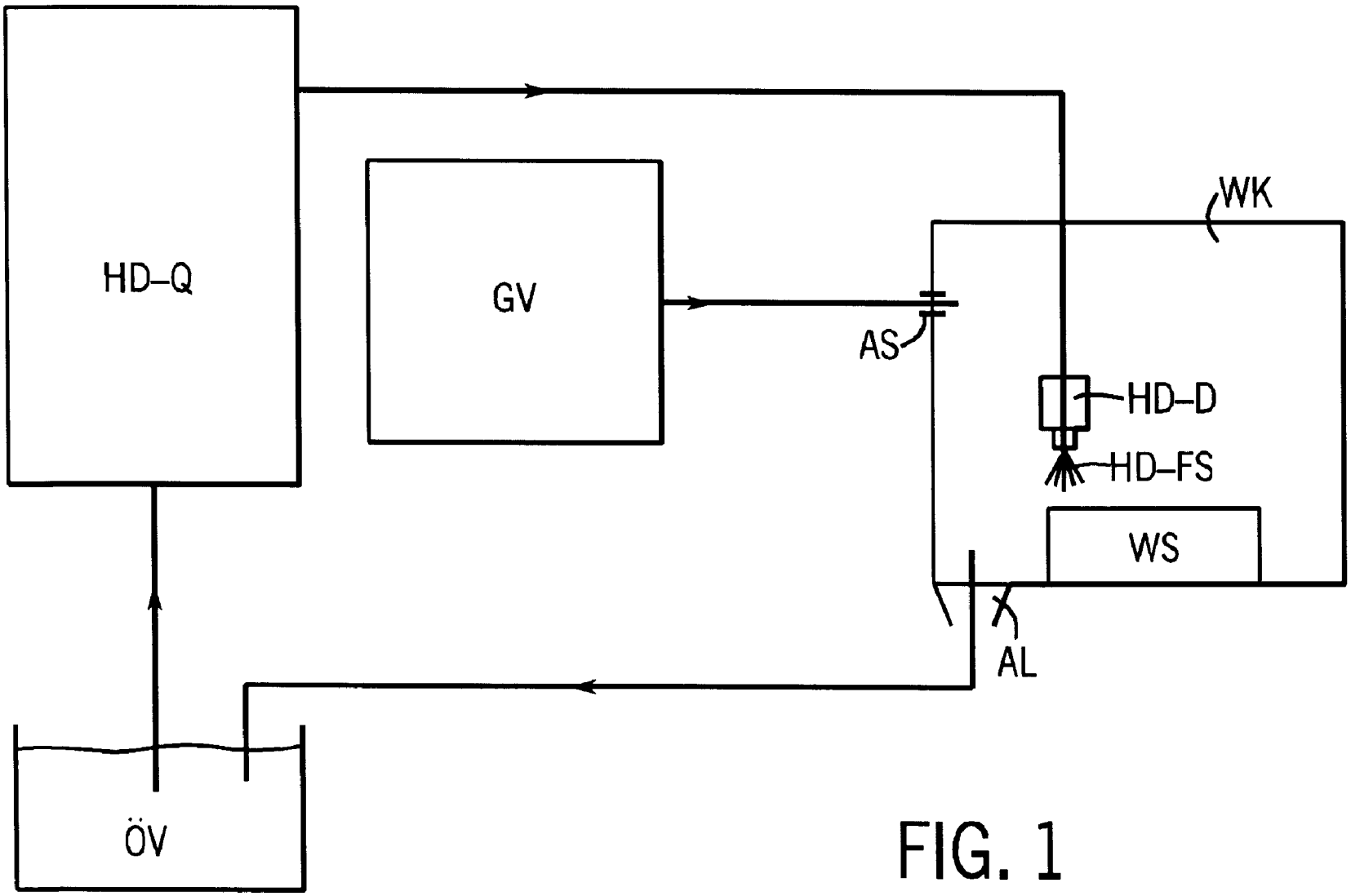
FIG. 1 is a block diagram to explain the new method.

A medium, having a proportion of oil greater than 50%, is contained in an oil container OV. The medium can be supplied from a high pressure generation device HD-Q, as is shown in FIG. 1. The medium is brought to a high pressure greater than 400 bar in the high pressure generation device HD-Q, whereby pumps, pneumatic regulators and similar devices are used in a known manner. The medium is then supplied to a high pressure nozzle HD-D, which is arranged in an encapsulated work-piece chamber WK and which is directed at the workpiece so that burrs can be removed therefrom. The high pressure liquid stream HD-FS exiting from the high pressure nozzle HD-D is very high in energy and breaks the burrs off of the work-piece and carries them away. The medium collecting in the work-piece chamber WK flows back into the oil container OV via a drain AL.

In order that the oil mist does not ignite or explode in the work-piece chamber WK, carbon dioxide (CO2) or nitrogen (N) can be passed into the work-piece chamber WK at least during the process of removing the burrs. The work-piece chamber WK has a connection AS for a line coming from an appropriate gas supply. If this additional safety measure is not required, then the connection AS can also be closed.

Figure 2:
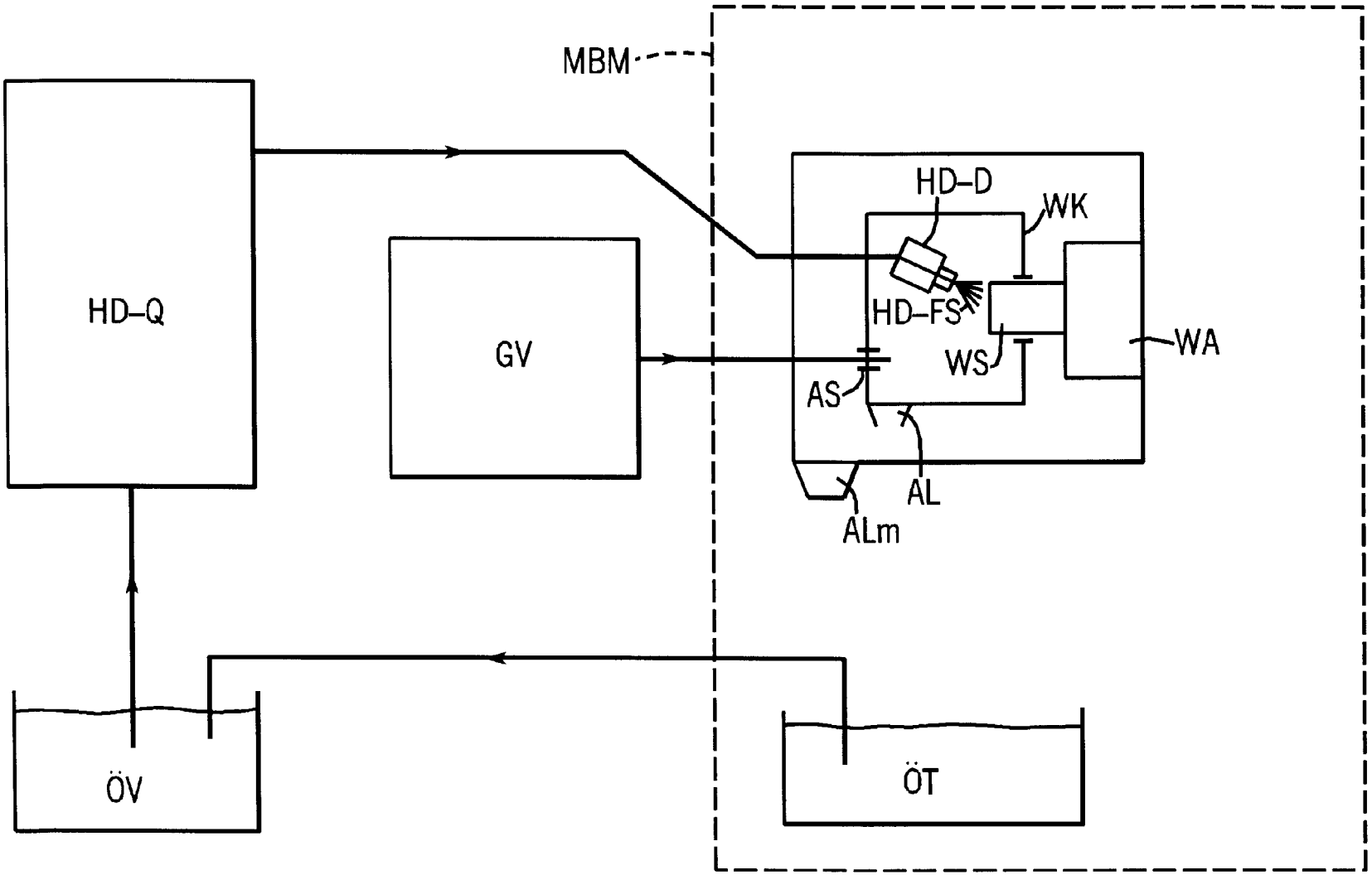
FIG. 2 is a block diagram with a process-integrated commercial metal processing machine.

Referring to FIG. 2, it is shown how the new burr removal process can be integrated into the manufacturing sequence of the work-piece on a commercial metal processing machine (i.e., rotary and round sensing machines with oil cooling and/or oil lubrication). The oil of the metal processing machine MBM is also used as a medium to remove the burrs. The oil is taken from the oil tank OT of the metal processing machine MBM and supplied, either directly or via an oil container OV, to the high pressure generating device HD-Q. The oil is then brought to a high pressure greater than 400 bar. The metal processing machine MBM features a plurality of processing stations into which a work-piece is brought in succession. Special tools for the processing steps that are to be undertaken are allocated to each of the processing stations. In a conventional manner, oil from the oil tank OT used to cool and/or lubricate the work-piece WS and/or the tool can be used for the processing. The oil is transported away with the shavings, and then the oil is liberated from the shavings and again supplied to the oil tank OT.

The removal of burrs is carried out in the last processing station in the cycle of the manufacturing sequence. This last processing station in the cycle of the manufacturing sequence features an encapsulated work-piece chamber WK. A work-piece WS is positioned in the encapsulated work-piece chamber WK to be held in the work-piece holder WA to be processed to a finished state. The high pressure nozzle HD-D is arranged in the work-piece chamber WK and directed at locations where burrs of the work-piece WS are to be removed. In order to remove the burrs, the direction and the distance of the high pressure nozzle HD-D from the work-piece WS can be changed and adjusted. Of course, a plurality of high pressure nozzles HD-D can also be arranged in the work-piece chamber WK so as to be directed at only one work-piece WS or at a plurality of workpieces WS.

The outlet AL of the work-piece chamber WK leads to a predetermined, machine-side collection outlet ALm and finally, back to the oil tank OT. The work-piece chamber WK can be connected to a gas supply GV for carbon dioxide (CO2) or nitrogen (N) via the connection AS.

The integration of burr removal into the commercial manufacturing sequence of the manufactured part has far reaching advantages, since not only is the work sequence simplified and the manufacturing costs reduced, but there are also no further encumbrances on the environment. This is because the broken-off burrs, like the shavings from the processing steps, are transported away in the metal processing machine and can be disposed of.

What is claimed is:

1. A device for removing burrs from a metal work-piece processed on a shavings removal metal processing machine, the metal processing machine having at least one processing station in a machine chamber thereof, wherein the device includes a high pressure nozzle supplied with a high pressure stream of liquid to be directed at the work-piece to be processed, the device comprising:

means for taking oil for a portion of the high pressure stream of liquid, wherein the oil is taken from an oil tank of the metal processing machine, the oil is brought to a high pressure of greater than 400 bar by a high pressure generating device, and the oil is supplied to the high pressure nozzle housed in an encapsulated work-piece chamber located in the machine chamber; wherein:

the work-piece is held in a work-piece holder after shavings have been removed therefrom and the work-piece is inserted into the encapsulated work-piece chamber which is provided as the last processing station of the metal processing machine having a plurality of processing stations in the machine chamber;

the work-piece chamber is provided with a drain exit which can be connected to an oil drain device of the metal processing machine;

the oil from the oil tank of the metal processing machine is supplied, any one of directly or indirectly, via an oil container of the high pressure generating device; and the work-piece chamber is provided with a connection for a line that comes from gas supply.

2. A method of removing burrs from a metal work-piece processed on a shavings removal metal processing machine, wherein the burrs are removed via a high pressure stream of liquid exiting from a high pressure nozzle directed at the work-piece to be processed, the method comprising the steps of:

providing a high pressure stream of liquid, wherein the liquid has a proportion of oil greater than 50% and a high pressure greater than 400 bar;

housing the high pressure nozzle and the work-piece to be processed in an encapsulated work-piece chamber during processing of the work-piece to be processed; and supplying carbon dioxide or nitrogen via a gas supply to the work-piece chamber after the housing of the high pressure nozzle and the work-piece in the encapsulated work-piece chamber and during processing of the work-piece to be processed.

3. A method of removing burrs from a metal work-piece processed on a shavings removal metal processing machine, wherein the burrs are removed via a high pressure stream of liquid exiting from a high pressure nozzle directed at the work-piece to be processed, the method comprising the steps of:

providing a high pressure stream of liquid, wherein the liquid has a proportion of oil greater than 50%, a high pressure greater than 400 bar, and is formed partially from oil used in the shavings removal metal processing machines, and housing the high pressure nozzle and the work-piece to be processed in an encapsulated work-piece chamber during processing of the work-piece to be processed.

4. The method of removing burrs from a metal work-piece according to claim 3, wherein the oil is a cutting oil.

5. The device for removing burrs from a metal work-piece processed on a shavings removal metal processing machine according to claim 1, wherein a plurality of high pressure nozzles, supplied by the high pressure generating device, are arranged in the work-piece chamber, such that each of the plurality of high pressure nozzles has an operating direction and a distance from the work-piece to be processed, the operating direction and the distance being adjustable.

6. A device for removing burrs from a metal work-piece processed on a shavings removal metal processing machine, the metal processing machine having at least one processing station in a machine chamber thereof, wherein the device includes a high pressure nozzle supplied with a high pressure stream of liquid to be directed at the work-piece to be processed, the device comprising:

means for taking oil for a portion of the high pressure stream of liquid, wherein the oil is taken from an oil tank of the metal processing machine, the oil is brought to a high pressure of greater than 400 bar by a high pressure generating device, and the oil is supplied to the high pressure nozzle housed in an encapsulated work-piece chamber located in the machine chamber wherein the work-piece chamber is provided with a connection for a line that comes from a gas supply.

7. The device for removing burrs from a metal work-piece processed on a shavings removal metal processing machine according to claim 6 wherein the work-piece is held in a workpiece holder after shavings have been removed therefrom and the work-piece is inserted into the encapsulated work-piece chamber which is provided as the last processing station of the metal processing machine having a plurality of processing stations in the machine chamber.

8. The device for removing burrs from a metal work-piece processed on a shavings removal metal processing machine according to claim 7, wherein the work-piece chamber is provided with a drain exit which can be connected to an oil drain device of the metal processing machine.

9. The device for removing burrs from a metal work-piece processed on a shavings removal metal processing machine according to claim 5, wherein the high pressure generating device is constructed as a component that is separate from the metal processing machine.

10. The device for removing burrs from a metal work-piece processed on a shavings removal metal processing machine according to claim 6, wherein the work-piece chamber is provided with a drain exit which can be connected to an oil drain device of the metal processing machine.

11. The device for removing burrs from a metal work-piece processed on a shavings removal metal processing machine according to claim 6, wherein the oil from the oil tank of the metal processing machine is supplied, any one of directly and indirectly, via an oil container of the high pressure generating device.

12. The device for removing burrs from a metal work-piece processed on a shavings removal metal processing machine according to claim 6, wherein a plurality of high pressure nozzles, supplied by the high pressure generating device, are arranged in the work-piece chamber, such that each of the plurality of high pressure nozzles has an operating direction and a distance from the work-piece to be processed, the operating direction and the distance being adjustable.

13. The device for removing burrs from a metal work-piece processed on a shavings removal metal processing machine according to claim 6, wherein the high pressure generating device is constructed as a component that is separate from the metal processing machine.

* * * * *